US006581649B2

(12) United States Patent
Jursich

(10) Patent No.: US 6,581,649 B2
(45) Date of Patent: Jun. 24, 2003

(54) METHODS AND APPARATUS FOR DELIVERING HIGH PURITY LIQUIDS WITH LOW VAPOR PRESSURE

(75) Inventor: Gregory M. Jursich, Clarendon Hills, IL (US)

(73) Assignees: L'Air Liquide - Societe Anonyme a'Directiore et Conseil de Surveillance pour l'Etude et l'Exploitation des Procedes Georges Claude, Paris (FR); American Air Liquide, Fremont, CA (US)

( * ) Notice: Subject to any disclaimer, the term of this patent is extended or adjusted under 35 U.S.C. 154(b) by 0 days.

(21) Appl. No.: 09/905,327

(22) Filed: Jul. 13, 2001

(65) Prior Publication Data

US 2003/0015249 A1 Jan. 23, 2003

(51) Int. Cl.[7] ..... B65B 31/00; B67C 3/00

(52) U.S. Cl. ..... 141/5; 141/4; 141/9; 141/51; 141/67; 141/302

(58) Field of Search ..... 141/4, 5, 9, 51, 141/52, 63, 64, 67, 285, 286, 301, 302, 309; 95/42, 149, 156, 214, 241, 273; 96/155, 189, 219, 240, 372

(56) References Cited

U.S. PATENT DOCUMENTS

| | | | | |
|---|---|---|---|---|
| 4,134,514 A | | 1/1979 | Schumacher et al. | |
| 4,140,735 A | | 2/1979 | Schumacher | |
| 4,298,037 A | | 11/1981 | Schumacher et al. | |
| 4,851,821 A | | 7/1989 | Howard et al. | |
| 4,966,207 A | | 10/1990 | Howard et al. | |
| 4,979,643 A | | 12/1990 | Lipisko et al. | |
| 5,151,395 A | * | 9/1992 | Tom | 502/407 |
| 5,156,827 A | * | 10/1992 | Tom et al. | 252/188.1 |
| 5,385,689 A | * | 1/1995 | Tom et al. | 252/181.4 |
| 5,590,695 A | | 1/1997 | Siegele et al. | |
| 5,964,254 A | | 10/1999 | Jackson | |

* cited by examiner

*Primary Examiner*—Timothy L. Maust
(74) *Attorney, Agent, or Firm*—Linda K. Russell; Christopher J. Cronin

(57) ABSTRACT

Methods and apparatus for delivery of high purity reactive liquids using gaseous assist are described, the apparatus comprising a container body, the container body having fluidly connected thereto a gas inlet and a reactive liquid outlet, the gas inlet fitted with a means adapted to hold a gas filter media, and a gas filter media positioned within said means adapted to hold a gas filter media, the gas inlet having a gas inlet valve, the liquid outlet having a liquid outlet valve.

21 Claims, 1 Drawing Sheet

METHODS AND APPARATUS FOR DELIVERING HIGH PURITY LIQUIDS WITH LOW VAPOR PRESSURE

BACKGROUND OF THE INVENTION

1. Field of the Invention

This invention relates generally to containers and methods for delivering liquid chemicals to a point of use. Mores specifically, to containers and methods wherein a gaseous media is used to push the liquid chemical out of the container.

2. Related Art

In certain chemical processes, such as chemical vapor deposition with organometallic precursors (MOCVD), there is often the need to pressurize supply reagent containers with inert gas in order to provide sufficient pressure in the container to deliver the chemical to the chemical vapor deposition tool. The vapor pressure of the liquid chemical at use temperature alone is frequently not sufficient to deliver the chemical to the chemical vapor deposition tool. Heating the chemical to raise its vapor pressure in these cases is not practical and often leads to premature degradation of the precursor chemical. Mechanical pumps may also lead to contamination.

It is known practice to introduce inert gas under pressure into a container in order to force chemical out of the container and down a process line. Indeed, certain suppliers advertise integral internal filters for gas delivery cylinders. However, unlike other applications, in MOCVD, the precursor such as pentaethoxy tantalum, zirconium t-butoxide, titanium tetrachloride, and the like, are extremely reactive to air contaminants, particularly moisture, to form metal oxide solids and various other hazardous materials (depending on the compound) often along with large releases of energy. For this reason, even minute traces of air contaminants cannot be tolerated in delivery equipment for such precursor chemicals. Furthermore, there is need to periodically change out supply containers as chemicals are consumed during processing of semiconductors. It is mainly in the change-out of containers where there is greatest potential to contaminate the delivery system and therefore the precursor chemical. For this reason good purge out sequences for delivery systems are required to be carried out as stipulated by semiconductor equipment manufacturers.

The need for good purging techniques are required for all air-sensitive compounds, even those with high vapor pressure precursors. However, in the case of low vapor pressure chemicals, the air contaminant issue is much more severe because such contaminants are introduced into the container and hence contaminate the entire container of product after which these contaminants cannot be simply flushed out using a purging manifold. Such contamination can be quite costly to the user since the cost of chemicals involved can reach several thousands of dollars per kilogram. Further, contamination by-products that form are much harder to remove and can leave solid residue on the seals of valves and other components downstream of the container leading to component failure, and possibly to serious health and costly down time risks.

To improve the purging operation during container change-outs, better manifolds have been designed over the years (for example, see U.S. Pat. Nos. 5,590,695 and 5,964,254). However, even though better manifold design indeed leads to improved purging efficiency, operationally mishaps can occur from human error, computer controller errors, and component failures. Many compounds can lead to solid residues on valve seals, for example, which in turn leads to valve malfunctions. When such problems occur at chemical container filling locations, the degraded product will be detected in the routine product quality control procedures; however, when it occurs at a user's site location the problem exhibits itself only after it causes down time and hazardous shut-down scenario.

An alternate means of preventing air contamination from entering the container is the use of breakseals (for example, see U.S. Pat. Nos. 4,134,514; 4,140,735; 4,298,037; 4,851,821; 4,966,207; and 4,979,643). As indicated in many previous patents, use of breakseals is indeed quite common in the handling of air-sensitive compounds and does effectively prevent direct contact of air into the container. However, in the case of inefficient purge sequences, component failure, computer control problem or human error, such breakseals will not prevent air contaminants from entering the container.

SUMMARY OF THE INVENTION

In accordance with the present invention, containers for delivery of high purity reactive liquids using gaseous assist are presented, as well as methods of use of same. In one embodiment, the container comprises a container body, the container body having fluidly connected thereto a gas inlet and a reactive liquid outlet, the gas inlet fitted with a means adapted to hold a gas filter media, preferably internally in the container, and a gas filter media positioned within the means adapted to hold a gas filter media, the gas inlet having a gas inlet valve, the liquid outlet having a liquid outlet valve. Preferred containers are those wherein the gas filter media is selected from a group consisting of silica, alumina, aluminosilicates; and containers wherein the liquid outlet is fitted with a means adapted to hold a liquid filter media, and a liquid filter media is positioned within the means adapted to hold a liquid filter media. Preferably, the liquid filter media is selected from a group consisting of silica, alumina, aluminosilicates. Other preferred containers are those wherein the means adapted to hold a gas filter media, and the gas filtered media, are integral to the container, and containers wherein the means adapted to hold a gas filter media comprises a conduit having a conduit inlet end positioned in said gas inlet of the container, the conduit having a conduit outlet end. Preferably, the conduit outlet end is internal to the container body. Preferably, the gas filter media is positioned between first and second gas filter media holders, both of the gas filter media holders being porous to gas used in gaseous assist delivery of liquid chemical adapted to be delivered from the container. Yet other preferred containers of the invention include those wherein the body has fluidly connected therewith a degas unit, the degas unit preferably integral with the liquid outlet and internal to the container body. Particularly preferred are containers of the invention wherein the reactive liquid does not make physical contact with the liquid filter media. This may be accomplished by use of means such as check valves, fine porous filter media, or even an elongated or coiled tube, as discussed herein. Also, the gaseous and liquid filter media may be external to the container in certain embodiments, positioned in close proximity to the container top.

Another aspect of the invention is a method of delivery of a high purity reactive liquid chemical to a point of use using gaseous assist, the method comprising the steps of:

(a) connecting the gas inlet of the inventive container to a source of gas, the container having liquid chemical therein;

(b) connecting the liquid outlet of the container to means able to accept the liquid chemical;

(c) initiating flow of gas by opening the gas inlet valve; and (d) preventing impurities from entering the container through the gas inlet means. Preferred methods of the invention are those including preventing impurities from leaving the container through the liquid outlet, preferably methods wherein step (d) comprises passing the gas through the gas filter media, the gas filter media selected from a group consisting of silica, alumina, aluminosilicates, and the like. Still other preferred methods are those wherein the step of preventing impurities from leaving the container comprises passing the liquid chemical through a liquid filter media, the liquid filter media preferably selected from the same group of filter media that the gas filter media is selected from.

A second method embodiment of delivery of a high purity reactive liquid chemical to a point of use using gaseous assist comprises the steps of:

(a) connecting the gas inlet of the inventive container to a source of gas, the container having liquid chemical therein;

(b) connecting the liquid outlet of the container to means able to accept the liquid chemical;

(c) initiating flow of gas by opening the gas inlet valve;

(d) preventing impurities from entering the container through the gas inlet means; and (e) degassing the liquid chemical before the liquid chemical exits the container. Preferred methods within this aspect of the invention are those wherein the method includes preventing impurities from leaving the container through the liquid outlet; methods wherein step (d) comprises passing the gas through the gas filter media, the gas filter media selected from the group consisting of alumina, silica, and aluminosilicates; and methods wherein the step of preventing impurities from leaving the container comprises passing liquid chemical through a liquid filter media. Other preferred methods include those wherein the liquid filter media is selected from the group consisting of silica, alumina, and aluminosilicates.

As used herein, the term "integral" means that a component is unable to be removed from the container body without great difficulty by an enduser. In this sense, "integral" does not mean that the component cannot be moved at all, but merely that the component cannot be removed during the normal course of use of the container.

As used herein the term "high purity" means that the liquid chemical is susceptible to contamination by contact with atmospheric air and its contaminants. Similarly, the term "reactive" means that the liquid chemical may decompose upon contact with air and its contaminants.

Chemicals such as organometallic precursors used in chemical vapor deposition need to be delivered at higher pressure than that of their own vapor pressure. A non-comprehensive list of chemicals which may benefit from the invention are listed in Table 1. This is easily done by pressurizing the container with inert gas to force the liquid out of the container. However, in such operations, such liquid chemicals run the risk of being contaminated with air impurities. These impurities, particularly moisture, react with many organometallic compounds to form other hazardous materials from the container. To prevent this from occurring, the container of the present invention has a design with an appropriate purifier to remove atmospheric contaminants before entering the container in the event of residual air being present in connecting lines which was not removed due to improper purge from operator handling, computer controller errors, or equipment component failures. Thus, better safety of chemical storage and improved assurance of chemical purity is attained which is often needed for critical processes such as that in the semiconductor industry. A particularly preferred method in accordance with the invention of preventing air contaminants from entering the container of the invention is to incorporate a purifying medium integral to the container itself and downstream of any line fittings that are disconnected for container change-outs. In accordance with the present invention, such purifier is preferably placed inside the container on the gas inlet port. Alternatively, such purifiers can be installed on both gas inlet and liquid outlet ports of the container. By making them an integral part of the container, no operator maintenance or intervention is required and the user is guaranteed the appropriate size and media to use for a particular chemical.

Thus, by incorporating a purifier on the gas inlet port of the container the inert gas used to pressurize the container will not contribute contaminants to the chemical. By making such purifier an integral part of the container, rather than fastening the purifier to the gas inlet line exterior to the container, there is far more certainty that all gas entering the container goes through the purifying media, thereby more effectively preventing error of contamination. Furthermore, preferably changing the filter media with every container change prevents over use of the filter media, and a human operator does not have to closely track usage of the filter media. The filter media is preferably economically sized for just one container volume of chemical, and preferably the filter media can be regenerated for use with another container.

As far as known to the inventor, no such container is available which incorporates purifiers directly into the container itself. Further, while it may be obvious that using gas purifies upstream of the gas flow can help assure purity of the gas itself, today, gas purity is rarely the problem since very high purities are usually attainable and commercially available. More frequently, the difficulty is in providing the user of liquid chemicals the assurance of reliable operations in purging out air contaminants sufficiently that result from installing new or replacement container by chemical delivery system.

The invention will be better understood with reference to the drawing figures and description of preferred embodiments which follows.

TABLE 1

Chemicals That May Benefit From the Invention

| Name | Chemical Structure | Chemical Name | Application | Film |
|---|---|---|---|---|
| PET | Ta(Oet)5 | Pentaethoxytantalum | High-k Capacitor, High-k Gate Oxide | Ta2O5 |
| Zr(t-OBu)4 | Zr(O(CH3)3)4 | Zirconium tertiary butoxide | High-k Gate Oxide | ZrO/ZrSiO |
| MS | (CH3)SiH3 | Monomethylsilane | Low-k | SiOC |
| 4MS | Si(CH3)4 | Tetramethylsilane | Barrier Low-k | SiC |
| TiCl4 | TiCl4 | Tetrachlorotitanium | Barrier Metal | TiN |
| TDMAT | Ti(Nme2)4 | Tetrakisdimethylaminotitanium | Barrier Metal | TiN, TiSiN |
| TDEAT | Ti(NEt2)4 | Tetrakisdiethylaminotitanium | Barrier Metal | TiN, TiSiN |
| EtCp2Ru | | BisEthyl Cyclo PentaDienyl Ruthenium | Electrode | Ru/RuO |
| DMDMOS | (CH3)2Si(OCH3)2 | Dimethyldimethoxysilane | Low-k | SiOC |
| HCDS | Si2Cl6 | Hexachlorodisilane | Etch Stopper, Cap Layer, Spacer | SiN |
| Zr(NEt2)4 | | Tetrakisdiethylaminozirconium | High-k Gate Oxide | ZrO/ZrSiO |
| Hf(NEt2)4 | | Tetrakisdiethylaminohafnium | High-k Gate Oxide | HfO/HfSiO |
| Si(Nme2)4 | Si(N(CH3)2)4 | Tetrakisdimethylaminosilane | High-k Gate Oxide | HfSiO/ZrSiO |
| Zr(Nme2)4 | Zr(N(CH3)2)4 | Tetrakisdimethylaminozirconium | High-k Gate Oxide | ZrO/ZrSiO |
| HSi(Net2)3 | HSi(N(C2H5)2)3 | Trisdiethylaminosilane | High-k Gate Oxide | HfSiO/ZrSiO |
| Hf(t-OBu)4 | Hf(O(CH3)3)4 | Hafniumtertiarybutoxide | High-k Gate Oxide | HfO/HfSiO |
| Si(i-Opr)4 | Si(O(CH(CH3)2)4 | Silicon iso propoxide | High-k Gate Oxide | HfSiO/ZrSiO |
| Si(NEt2)4 | Si(N(C2H5)2)4 | Tetrakisdiethylaminosilane | High-k Gate Oxide | HfSiO/ZrSiO |
| 3MS | (CH3)3SiH | Trimethylsilane | Low-k, Barrier Low-k | SiOC, SiC |
| TMCTS | C4H16O4Si4 ?? | Tetramethylcyclotetrasiloxane | Low-k | SiOC |
| HSi(NMe2)3 | HSi(N(CH3)2)3 | Trisdimethylaminosilane | High-k Gate Oxide | HfSiO/ZrSiO |
| TATDMAE | Ta(OC2H5)4(C4H10NO | Tantalumtetraehoxydimethyl-aminoethoxide | High-k Capacitor, High-k Gate Oxide | Ta2O5 |
| ZrCl4 | ZrCl4 | TetraChlorozirconium | High-k Gate Oxide | ZrO/ZrSiO |
| Pt(hfa)2 | | Bis Hexa Fluoro Acetyl Acetonato Platinum | Electrode | Pt/PtO |
| Ir(acac)3 | | Tris Acetyl Acetonato Iridium | Electrode | Ir/IrO |
| PbDPM2 | | Bis Di Pivaloyl Methanato Lead | Ferro Electric (PZT) | PZT |
| ZrDPM | | Tetra Di Pivaloyl Methanato Zirconium | Ferro Electric (PZT) | PZT |
| Ti(DPM)2(i-OPr)2 | | | Ferro Electric (PZT) | PZT |
| Sr(DPM)2 | | Bis Di Pivaloyl Methanato strontium | Ferro Electric (SBT) | SBT |

DESCRIPTION OF PREFERRED EMBODIMENTS

Figure 1:
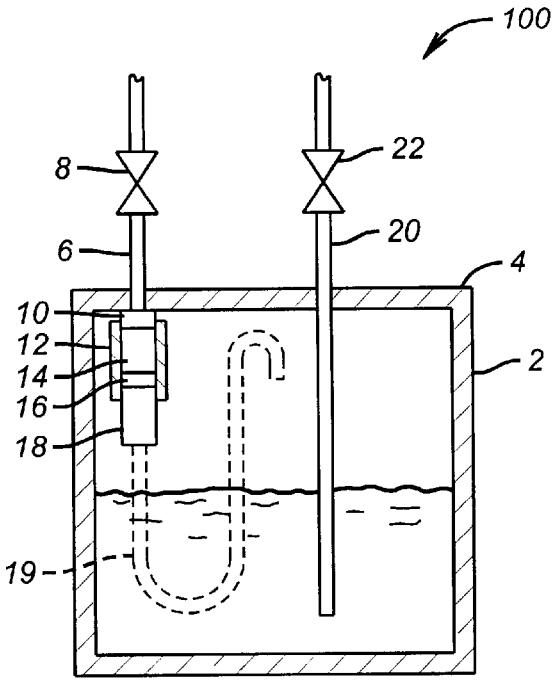
FIG. 1 illustrates schematically, in side-sectional view, a first container embodiment of the invention.

Referring now to the Figures, FIG. 1 illustrates a first embodiment 100 of a container of the invention. Container 100 includes a container body 2 having a top 4 and a gas inlet line 6, through which gas is controlled using the gas inlet valve 8. Gas inlet tube 6 traverses through top 4 of container 2 and preferably enters first porous media disc 10. Disc 10 is held in place by a tube 12, and tube 12 in turn holds in place a gas filter media cartridge 14 along with a second force disc 16. Completing the gas inlet is a gas exit tube 18 which may or may not be present in all embodiments. Tube 18 prevents backsplash of liquid chemical into porous media 16. Again, porous media 10, 16 and gas outlet tube 18 are only preferred and not necessary to the practice of the invention. The dotted portion 19 illustrates that tube 18 May be extended in an "S" shape, to help preclude liquid from entering the gas filter media 14. Completing the first embodiment is a liquid exit tube 20 and a liquid control valve 22. Liquid exit tube 20 extends through top 4 of container body 2 and into the liquid chemical, and preferentially extends near the bottom of container body 2 so that the chemical may be withdrawn even when the liquid level is low. It may be seen by this embodiment that any air impurities that may seek to enter container body 2 through the gas inlet will be caught by the filter media 14 and hence not enter into the container.

Figure 2:
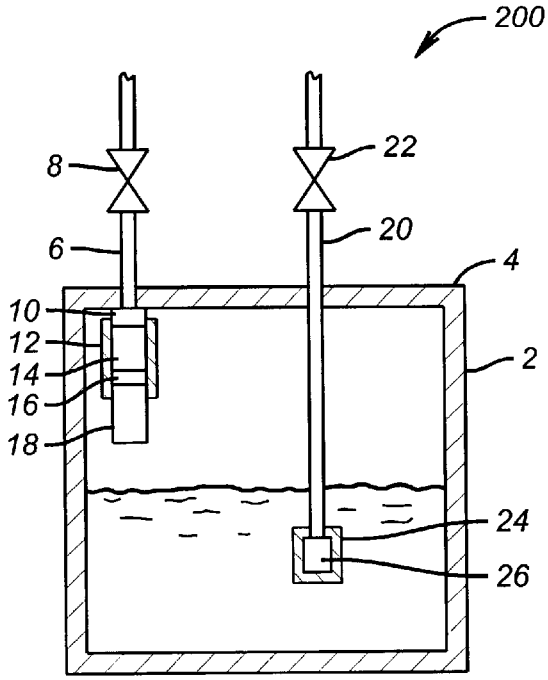
FIG. 2 illustrates schematically, in side-sectional view, a second container embodiment of the invention.

FIG. 2 illustrates a second embodiment 200 of the container of the invention, which is similar to the embodiment 100 of FIG. 1, however, container 200 of FIG. 2 includes a liquid filter media 26 held within a liquid filter media cartridge 24 both of which are attached to the end of liquid exit tube 20. Although impurities are prevented from entering container body 2 through the inert gas inlet tube 6, there could be occasion for impurities to generate within container 2 itself, for example, if the liquid chemical is exposed to higher than normal temperatures for prolonged time. Liquid filter 26 will filter out any developed impurities which happen to be generated within the container 2 and will not exit with liquid chemical out liquid exit tube 20.

Figure 3:
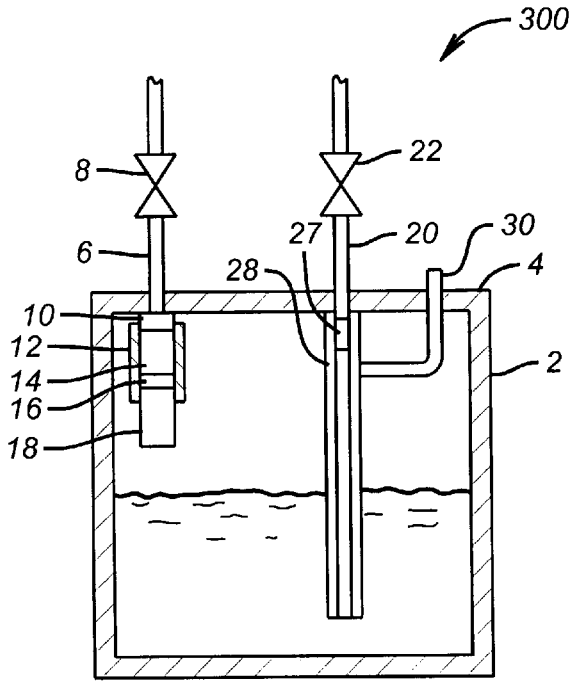
FIG. 3 illustrates schematically, in side-sectional view, a third container embodiment of the invention.

Another embodiment of the liquid delivery container of the invention is illustrated in FIG. 3 as embodiment 300. Embodiment 300 of FIG. 3 has all of the features of embodiment 200 of FIG. 2 on the gas inlet, but includes a pipe-in-pipe dip tube 28. Dip tube 28 also includes a gas exit tube 30 which allows extraneous gas developed from impurities which may be generated within container body 2 to exit the system. These units are sometimes referred to as permeable degas units. Typically, gas exit 30 is attached to a suitable negative pressure device, such as a hood, exhaust manifold, or to a source of vacuum. In this embodiment, tube 20 preferably comprises a gas permeable material, having the function allowing gas to escape from liquid flowing therein. Also included in this embodiment is a liquid filter media 27.

As illustrated in FIG. 1, in one of the simplest embodiments, the purifying media is enclosed in a small tube extending from the gas inlet port of the container. Preferably, the both ends of the purifying media have fitted therewith a fitted metal disc or other fine filtering substrate that can be welded in place in order to contain the gas filtering media. In this particular application, a proper choice of gas filtration media is important since it not only must remove trace air contaminants but also must be compatible with the liquid chemical itself. In this application, silica, alumina, and aluminosilicate materials are preferred since they are chemically inert and yet have the capability to remove moisture to very low levels. Furthermore, prewashing the purifying material itself with the liquid chemical to be delivered from container 2 will help assure compatibility. The volume of gas required to pass through the gas filter media is not very large, typically only two to three times that of the container volume itself, more preferably 3 or 4 times, so that there is no large capacity requirement for the gas purifying media. This allows a large range of materials to be used. The only critical requirement is that the gas filtering media be chemically compatible with the liquid chemical itself. The liquid contact with the gas purifying media can easily be eliminated by means of use of very fine porous filter substrates, a check valve, or by extending tube 18, as illustrated in FIG. 1, below the downstream gas purifying media so as to maintain an inert gas pocket between gas filter media and the liquid itself. An alternative "S"-shaped tubing embodiment 19 is illustrated in FIG. 1.

Alternatively, and as illustrated in FIGS. 2 and 3, purification media can be placed on both gas inlet and liquid outlet, provided the purifying media is fully compatible with the liquid chemical being delivered and the design can accommodate liquid flow rates required by the user. Since some liquid chemicals can degrade over time during storage to form solid particulates, the use of an appropriate filter on the outlet port can be very desirable. Again, as with the integral gas inlet filter media having a liquid particulate filter on the outlet port integral to the container itself is advantageous to the user in that the liquid filtration media has been properly pre-selected by the supplier and it "automatically" undergoes replacement with every container change-out. In an alternative embodiment, purifying media, whether for gas or liquid, are preferably contained in the gas and liquid valve ports. This may have advantages for assembly and disassembly.

As with the gaseous and liquid filtration media, if a permeable degas cartridge is used it is preferably integral to the container. This assures proper selection of the components compatible with the liquid chemical being delivered and the user does not have to worry that the appropriate permeable degas cartridge is installed in containers delivering appropriate chemical to the end use. It becomes an automatic replacement as the containers are changed out.

Methods of use of the containers of the invention are now described. As in most chemical usage situations, the procedures are cyclical. Assuming an empty container situation, the end user may prefer to simply purge container body 2 by keeping valves 8 and 22 open for a time, either controlled by human or computer control. After a sufficient purge time, valves 8 and 22 are closed and the container is disconnected from the user system through connections upstream of valve 8 and downstream of valve 22 (not shown). A new container 100 is then attached to the system. If the user desires flow of liquid, valve 22 is opened and valve 8 is opened, allowing gas to flow into container body 2, thereby pushing liquid chemical out through liquid exit tube 20 and liquid exit valve 22. As with the purge out sequence, this may be human controlled or computer controlled.

As gas enters the system through valve 8 and tube 6 the gas will be purified, or at least air contaminants will be removed, through filter media 14. If the container embodiment 200 of FIG. 2 is used, furthermore, any impurities which are generated inside the container after the container itself has been installed, will be removed by liquid filter media 26 as liquid chemical is being delivered out of container 200. Finally, as a further assurance of purity, a gas permeable pipe-in-pipe dip tube 28 with filter media 27 may be installed integrally as in the embodiment 300 of FIG. 3, thereby comprising the greatest assurance of purity for the end user. In embodiment 300, as inert gas enters through valve 8 and tube 6, and is maintained clean by gas filter media 14, liquid filter media 27 maintains liquid of high purity, while any gas that is developed from the liquid chemical is removed by the permeable unit 28, through tube 30 which is connected to a negative pressure source.

Although not a feature of the present invention, it is preferable for containers of the invention to be equipped with liquid level sensing. This may either be accomplished through known means, such as float sensors, or through novel methods such as liquid level sensing via gas volume expansion monitoring. The containers of the invention my also be equipped with quick-purge canister change-out connections, thermally heated degas units, and delivery manifolds with liquid recovery (solvent or process chemical flushing) recovery canisters. Containers of the invention may also be supplied with mechanical pressurization (piston type) or bag (canisters). Solvent purge cleaning may also be equipped with the containers of the invention. All of these components are preferably "modular" add-on design, which can be installed and uninstalled in quick fashion by the user. For example, a modular design might include in one module all utilities such as gas pressurization flow, vacuum and solvent flow, while another module may consist of liquid output functions such as flow accumulation, flow meters, pressure sensors, filters, and degas units. Another module may contain purging and pressurizing sequences of valves.

Another module may include a scale to weigh the containers of the invention as they are being emptied, the scale may have variable height supports. Containers of the invention may include wheels, a weight scale, a bypass line, sight glasses for level sensing, UV/VIS level sensing and chemical purity monitoring, gas inlet purifies and degassing dip tubes. Specially preferred are UV/VIS probe sensors for level and purity monitoring as more fully explained in Applicant's copending application Ser. No. 09/905,598, filed on even date herewith, and incorporated by reference herein.

Preferred methods and apparatus for practicing the present invention have been described. It will be understood and readily apparent to the skilled artisan that many changes and modifications may be made to the above-described embodiments without departing from the scope of the present invention. The foregoing is illustrative only and other embodiments of the methods and apparatus may be employed without departing from the scope of the invention defined by the following claims.

What is claimed is:

1. A container for delivery of high purity reactive liquids using gaseous assist, the container comprising:

a) a container body containing at least a cavity therein;

b) a gas inlet in fluid communication with said cavity and including a gas in let valve;

c) a reactive liquid outlet in fluid communication with said cavity and including a liquid outlet valve for conveying the high purity reactive liquid therefrom d) a gas filter media; and e) a means adapted to hold said gas filter media and being in fluid communication with and downstream of said inlet valve, wherein said gas filter media is positioned within said means and prevents air impurities from entering said cavity from said gas inlet.

2. The container of claim 1 wherein the gas filter media is selected from a group consisting of silica, alumina, aluminosilicates.

3. The container of claim 1 wherein the liquid outlet is fitted with a means adapted to hold a liquid filter media, and a liquid filter media positioned within said means adapted to hold a liquid filter media.

4. The container of claim 3 wherein the liquid filter media is selected from a group consisting of silica, alumina, aluminosilicates.

5. The container of claim 1 wherein the means adapted to hold a gas filter media, and the gas filter media, are integral to said container body.

6. The container of claim 1 wherein the means adapted to hold a gas filter media comprises a conduit having a conduit inlet and positioned in said gas inlet of said container, said conduit having a conduit outlet end.

7. The container of claim 6 wherein said conduit outlet end is internal to said container body.

8. The container of claim 7 wherein the gas filter media is positioned between first and second gas filter media holders, both of said gas filter media holders being porous to gas used in gaseous assist delivery of liquid chemical adapted to be delivered from said container.

9. The container of claim 1 wherein the reactive liquid outlet has fluidly connected therewith means for degassing the reactive liquid.

10. Container in accordance with claim 9 wherein said means for degassing is integral with said reactive liquid outlet and is internal to the container body.

11. A method of delivery of a high purity reactive liquid chemical to a point of use using gaseous assist, the method comprising the steps of:

(a) connecting the gas inlet of the container of claim 1 to a source of gas, the container of claim 1 having liquid chemical therein;

(b) connecting the liquid outlet of the container of claim 1 to means able to accept said liquid chemical;

(c) initiating flow of gas by opening said gas inlet valve;

(d) preventing air impurities from entering said container through said gas inlet means; and (e) allowing the liquid chemical to flow from the reactive liquid outlet valve.

12. The method in accordance with claim 11 including preventing impurities from leaving the container through said liquid outlet.

13. The method of claim 11 wherein step (d) comprises passing said gas through said gas filter media, said gas filter media selected from a group consisting of silica, alumina, and aluminosilicates.

14. The method in accordance with claim 12 wherein the step of preventing impurities from leaving the container comprises passing the liquid chemical through a liquid filter media.

15. The method in accordance with claim 14, wherein the liquid filter media is selected from a group consisting of silica, alumina, aluminosilicates.

16. A method of delivery of a high purity reactive liquid chemical to a point of use using gaseous assist, the method comprising the steps of:

(a) connecting the gas inlet of the container of claim 1 to a source of gas, the container of claim 1 having liquid chemical therein;

(b) connecting the liquid outlet of the container of claim 1 to means able to accept said liquid chemical;

(c) initiating flow of gas by opening said gas inlet valve;

(d) preventing air impurities from entering said container through said gas inlet means; and (e) degassing said liquid chemical before or just after said liquid chemical is allowed to exit said container.

17. The method in accordance with claim 16, including preventing impurities from leaving the container through said liquid outlet.

18. The method in accordance with claim 16 wherein step (d) comprises passing said gas through said gas filter media, said gas filter media selected from the group consisting of alumina, silica, and aluminosilicates.

19. The method in accordance with claim 17 wherein the step of preventing impurities from leaving the container comprises passing the liquid chemical through a liquid filter media.

20. The method in accordance with claim 19 wherein said liquid filter media is selected from the group consisting of silica, alumina, and aluminosilicates.

21. The container of claim 1, further comprising a liquid exit tube in fluid communication with said reactive liquid outlet and extending downwardly into said cavity thereby enabling delivery of the liquid chemical therethrough and conveyance of the liquid chemical from said reactive liquid outlet.

* * * * *